US007264467B1

(12) United States Patent
Mitchell et al.

(10) Patent No.: US 7,264,467 B1
(45) Date of Patent: Sep. 4, 2007

(54) CONVECTION OVEN WITH TURBO FLOW AIR NOZZLE TO INCREASE AIR FLOW AND METHOD OF USING SAME

(75) Inventors: Jeffrey C. Mitchell, East Troy, WI (US); Yougui Zhao, Sheboygan, WI (US)

(73) Assignee: International Thermal Systems, LLC, Milwaukee, WI (US)

( * ) Notice: Subject to any disclaimer, the term of this patent is extended or adjusted under 35 U.S.C. 154(b) by 206 days.

(21) Appl. No.: 11/158,893

(22) Filed: Jun. 22, 2005

(51) Int. Cl.
*F27B 7/14* (2006.01)

(52) U.S. Cl. ..... 432/147; 432/175; 34/666; 34/270

(58) Field of Classification Search ..... 432/120, 432/147, 209, 175; 34/270, 271, 272, 666, 34/205

See application file for complete search history.

(56) References Cited

U.S. PATENT DOCUMENTS

| | | | | | |
|---|---|---|---|---|---|
| 1,663,029 | A | | 3/1928 | Straight | |
| 3,219,328 | A | | 11/1965 | Miller | |
| 3,854,865 | A | | 12/1974 | Fay | |
| 3,991,737 | A | | 11/1976 | Del Fabbro | |
| 4,005,981 | A | | 2/1977 | Turnbull | |
| 4,032,289 | A | * | 6/1977 | Johnson et al. | 432/200 |
| 4,153,236 | A | | 5/1979 | Elhaus | |
| 4,408,986 | A | * | 10/1983 | Soraya et al. | 432/6 |
| 4,516,012 | A | | 5/1985 | Smith et al. | |
| 4,733,481 | A | * | 3/1988 | Hubbert | 34/666 |
| 4,785,552 | A | * | 11/1988 | Best | 34/418 |
| 4,943,447 | A | | 7/1990 | Nelson et al. | |
| 4,972,606 | A | * | 11/1990 | Stoltz | 34/271 |
| 5,456,023 | A | | 10/1995 | Farnan | |
| 5,588,830 | A | * | 12/1996 | Josefsson et al. | 432/147 |
| 5,601,070 | A | | 2/1997 | Hotard et al. | |
| 5,657,555 | A | | 8/1997 | Milojevic et al. | |
| 5,661,912 | A | * | 9/1997 | Bhatnagar et al. | 34/270 |
| 5,875,565 | A | | 3/1999 | Bowman | |
| 6,062,850 | A | * | 5/2000 | Ino et al. | 432/143 |
| 6,769,909 | B2 | * | 8/2004 | Schwartz | 432/175 |
| 7,063,528 | B2 | * | 6/2006 | Klobucar et al. | 432/147 |

FOREIGN PATENT DOCUMENTS

| | | |
|---|---|---|
| JP | 57155039 | 9/1982 |

OTHER PUBLICATIONS

LTG Technologies, Inc., Presentation of Tom Zeeff, IMDA—Fall 2000 Conference, Tampa, Florida.

* cited by examiner

*Primary Examiner*—Gregory Wilson
(74) *Attorney, Agent, or Firm*—Reinhart Boerner Van Deuren sc

(57) ABSTRACT

A convection oven that achieves a substantially enhanced degree of air flow through the use of a special nozzle design. Turbo flow air nozzles create an air flow pattern to provide higher velocity airflow with a smaller fan size and ductwork. The turbo flow air nozzles include main supply nozzles that direct high velocity air through air entrainment and mixing sections that entrain air from the oven interior to generate the increased air flow in a heat transfer zone of the oven. Appropriate ductwork is provided to direct air from a fan or fans to the supply nozzles to generate a high velocity air flow therethrough.

20 Claims, 3 Drawing Sheets

CONVECTION OVEN WITH TURBO FLOW AIR NOZZLE TO INCREASE AIR FLOW AND METHOD OF USING SAME

FIELD OF THE INVENTION

This invention pertains generally to ovens, particularly industrial convection ovens, and more particularly to systems and methods for enhancing air flow within such ovens.

BACKGROUND OF THE INVENTION

A variety of different industrial ovens are used for a variety of different purposes. For example, industrial ovens are used to cure powder painted steel sheets and other parts. In this application, and all others, it is necessary to keep the work piece within a desired temperature range for a desired period of time to achieve the desired result. If the work piece temperature is allowed to climb too high the work piece will be damaged. If the work piece temperature is too low or inconstant the work piece may not be cured properly, or at least the time required to cure the work piece, and thus the flow of work product through the oven, is reduced. Maintaining optimum work piece temperatures is made more complicated for certain work pieces, such as metal articles, which act as heat sinks affecting the oven temperature, often significantly.

Convection ovens use a fan or fans to re-circulate air in the oven to enhance the heating characteristics of the oven. Movement of heated air over the work piece to be heated enhances oven operating efficiency. It has been found that oven operating efficiency can be increased by increasing air flow velocity over the work piece. One way to achieve this result is to increase air flow throughout the oven. However, the fan size and ductwork needed to provide the required air velocity throughout an oven is often expensive and inefficient.

As an alternative, attempts have been made to increase air velocity in an oven specifically through a heat transfer zone of the oven where the work piece is to be placed or through which the work piece is to be moved. For example, some ovens have an air supply duct located in the bottom of the oven with air nozzles that discharge air upward over the work piece being heated in the heat transfer zone of the oven. Other ovens have two air supply ducts, one located in the upper corner on each side of the oven. High velocity nozzles are used to blow air vertically downward along the oven walls where it is then turned upward over the work piece being heated in the heat transfer zone. This design has proven effective in maintaining uniformity of both oven air temperature, and air velocity, across the work piece. It helps to even out the temperature rise of the entire work piece and to minimize flutter of suspended work pieces due to uneven air velocities. An additional benefit is that the oven walls are kept hot, reducing the tendency for condensation to build up. The high velocity nozzles used in this application are designed to induce a venturi effect that draws in a significant amount of the air inside the oven chamber. The result is that the volume of air passing through the work piece is much higher than the capacity of the circulation fans. This enhances temperature uniformity and heat transfer as well as reduces the electrical energy consumption of the circulation fan motors. However, the use of high velocity air nozzles alone is limited in that it does not provide control of the quantity and direction of air flow through the oven.

What is desired, therefore, is an improved convection oven that employs turbo flow air nozzles for increasing air flow through the heat transfer zone of the oven and a method of using such an oven to heat work pieces.

SUMMARY OF THE INVENTION

The present invention provides a convection oven, and method of using same, that achieves a substantially enhanced degree of air flow through the use of a turbo flow nozzle design. Ovens contemplated by the present invention may be used to dry powder coated paint on metal articles or for any other application. A convection oven in accordance with the present invention employs turbo flow air nozzles along with appropriate ductwork to create a specific air flow pattern to provide a high velocity airflow in a heat transfer zone with a smaller fan size and ductwork, and thus may be operated more efficiently than conventional industrial convection ovens.

A convection oven in accordance with the present invention employs turbo flow air nozzles that are positioned within the oven. For example, turbo flow air nozzles may be positioned near the top of the oven and to the sides of a heat transfer zone. Alternatively, the turbo flow air nozzles may be positioned at any desired location in the oven to create the desired enhanced air flow in the heat transfer zone. The turbo flow air nozzles include one or more main supply nozzles that direct high velocity air through air entrainment and mixing sections. For example, a plurality of conical main supply nozzles may be employed to direct high velocity air through a rectangular air entrainment and mixing section. Alternatively, main supply nozzles and air entrainment and mixing sections having other shapes may be used to form the turbo flow air nozzles. Appropriate ductwork may be provided to direct air from a fan or fans to the supply nozzles to generate a high velocity air flow therethrough.

During operation of a convection oven in accordance with the present invention convection airflow through a heat transfer zone is enhanced by the use of the turbo flow air nozzles. Airflow from a recirculation fan flows through a supply duct to the one or more supply nozzles to produce a high velocity air flow that flows through the air entrainment and mixing section, turns and flows through the heat transfer zone, and flows through a return path, e.g., via a return duct, back to the recirculation fan. Air from the interior of the oven is entrained by the high velocity air directed into the air entrainment and mixing section from the supply nozzles and flows through the air entrainment and mixing section, is directed through the main heat transfer zone, and then turns and flows back into the air entrainment and mixing section.

By re-circulating oven air through the heat transfer zone using turbo flow air nozzles in this manner, a convection oven in accordance with the present invention achieves increased air flow through the heat transfer zone using significantly less fan capacity than would be required to achieve the same air flow using conventional air flow nozzles alone. Thus, a less expensive and physically smaller air circulation fan system may be employed, taking up less space in the facility where the oven is installed. Since the increased air flow provides better heat transfer to the work piece, lower temperature air may be used, reducing the risk of overheating the work piece. Also, better heat transfer can reduce the amount of time needed to bring the work piece to the desired temperature. If less time is needed, the overall oven size can be reduced. A smaller oven is less expensive, takes up less space in the facility where it is installed, and has less heat loss through its walls. All of these advantages of a convection oven with turbo flow air nozzles in accordance with the present invention result in a convection oven that is more efficient and less expensive to implement and to operate.

Further objects, features, and advantages of the present invention will be apparent from the following detailed description taken in conjunction with the accompanying drawings.

DETAILED DESCRIPTION OF THE INVENTION

Figure 1:
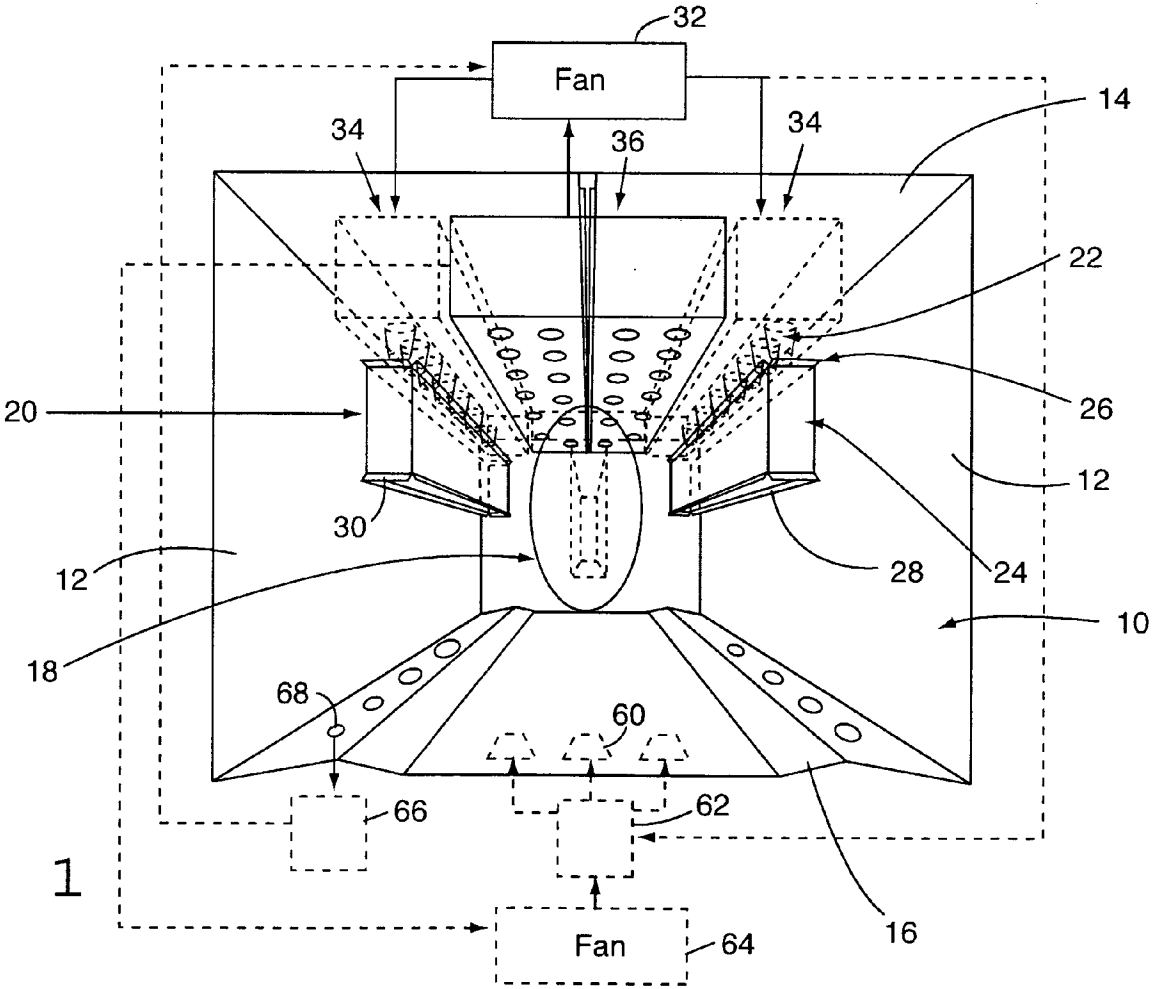
FIG. 1 is a perspective view illustration of an exemplary convection oven in accordance with the present invention employing turbo flow air nozzles to increase airflow therethrough.

An exemplary convection oven 10 in accordance with the present invention, incorporating turbo flow air nozzles to increase air flow therethrough, will be described in detail first with reference to FIG. 1. The present invention may be embodied in any otherwise generally conventional industrial convection oven design as used for the heating of any type of work piece for any desired purpose. For example, the present invention may be implemented in a conventional tunnel type oven, through which work pieces are moved in a continuous work flow, via conveyors supporting the work pieces from either above or below, or in tunnel or entirely enclosed ovens in which work pieces are placed in position for heating. Such ovens may be heated in any conventional manner. The present invention may be incorporated in all or any selected zones of an oven that includes, for example, one or more come-up zones, used to elevate the temperature of a work piece quickly and uniformly to a desired bake temperature, and one or more bake zones. In particular, the present invention has been found to be very useful for the effective and efficient curing of powder paint on sheet steel parts of various thickness. However, the present invention may be employed for the heating of any type of work piece where increased throughput and/or operating efficiency and reduced cost is desired.

A convection oven 10 in accordance with the present invention has an oven interior that is defined by at least side walls 12, a top wall 14 and a bottom 16. The walls 12, 14, and 16 of the oven 10 may be formed in a conventional manner of conventional appropriate materials, such as sheet steel, and insulated appropriately to maintain heat in the oven 10. The bottom 16 of the oven 10 may be a separate wall structure or simply a floor (typically concrete) of the building in which the oven 10 is placed for operation. A portion 18 of the oven 10 forms a heat transfer zone. In the exemplary oven 10 illustrated and described herein the heat transfer zone 18 is formed in the center of the oven. It should be understood, however, that heat transfer zones 18 may be located in other and various locations within a convection oven in accordance with the present invention. Work pieces are placed in or pass through the heat transfer zone 18 where, in accordance with the present invention, heat is transferred efficiently to the work piece to achieve a desired result, e.g., to cure the powder paint coating on a sheet steel product.

In accordance with the present invention, at least one turbo flow air nozzle 20 is provided within the oven 10. In the exemplary convection oven 10 in accordance with the present invention illustrated and described herein, turbo flow air nozzles 20 are provided at or near the top 14 of the oven 10 and near the side walls 12 of the oven 10 and are directed in a generally downward direction. It should be understood, however, that turbo flow air nozzles 20 may be positioned anywhere within a convection oven 10 in accordance with the present invention, e.g., at the center top of the oven, on the sides of the oven, and/or in the bottom of the oven, and directed in any desired direction, e.g., downward, sideways, and/or upward, thereby to generate increased air flow at desired heat transfer zones 18 in the oven 10. For example, for a convection oven in accordance with the present invention wherein a work piece is conveyed in a serpentine pattern back and forth through the oven, turbo flow air nozzles may be positioned near the top of the oven between each straight section of the serpentine conveyor and directed downward, thereby providing increase air flow in heat transfer zones extending along the length of the conveyor through the oven.

The turbo flow air nozzles 20 preferably include at least one high velocity air supply nozzle 22 and an air entrainment and mixing section 24. The high velocity air supply nozzles 22 are positioned with respect to the air entrainment and mixing section 24 so as to direct air at a high velocity through the air entrainment and mixing section 24. The air entrainment and mixing section 24 has closed side walls and an open first end 26 and open second end 28. The open first end 26 of the air entrainment and mixing section 22 is positioned with respect to the air supply nozzles 22 such that high velocity air is directed into the open first end 26 of the air entrainment and mixing section 24 from the air supply nozzles 22. The open first end 26 of the air entrainment and mixing section 24 also is in fluid communication with the interior of the oven 10 such that the open first end 26 of the air entrainment and mixing section 24 forms an air entrainment lead in section for air in the interior of the oven when in operation, as will be discussed in more detail below.

As illustrated, multiple adjacent conical air supply nozzles 22 may be used to provide high velocity air through a single elongated rectangular box shaped air entrainment and mixing section 24. An outward extending flange 30, e.g., extending outward from the walls of the air entrainment and mixing section 24, may be formed around the open first 26 and second 28 ends of the air entrainment and mixing section 24. Alternatively, each air entrainment and mixing section 24 may be supplied by a single air supply nozzle 22 that provides high velocity air therethrough. For example, a single elongated slot shaped air supply nozzle may be used to provide high velocity air through an air entrainment and mixing section 24 having an elongated rectangular box shape as illustrated herein.

It should be understood that the turbo flow air nozzles 20 employed in a convection oven 10 in accordance with the present invention may be formed differently from the nozzles 20 illustrated and described by example herein, as will be known to those skilled in the art. For example, the air supply nozzles 22 may be cylindrical, rather than conical, in shape. Each such cylindrical or conical air supply nozzle 22 may have its own associated cylindrical or conical shaped air entrainment and mixing section 24. The air entrainment and mixing sections 24 may be separated into separate entrainment sections and mixing sections placed in series and in fluid communication with each other. The separate entrainment sections and mixing sections may have different shapes. For example, the entrainment section may have a conical shape, similar to the shape of the supply nozzles illustrated herein, with the corresponding mixing section having a cylindrical shape.

Air flow to the air supply nozzles 22 preferably is provided by a fan 32 via appropriate supply ducts 34. The size, capacity and position of the fan 32 and supply ducts 34 with respect to the oven 10 will depend upon the specific position, number, and orientation of the turbo flow air nozzles 20 being employed as well as the desired oven operating temperature and air flow to be achieved in the established heat transfer zone or zones therein. For example, for an application as illustrated, with the turbo flow air nozzles 20 positioned near the top 14 and side 12 walls of the convection oven 10, the supply ducts 34 preferably may be run along the top 14 of the oven, near the side walls 12 thereof.

Return air is drawn from the interior of the oven via an appropriate return path. For example, return air may be drawn by the fan 32 from the interior of the oven 10 via a return duct 36. For the exemplary application of the invention as illustrated herein, the return duct 36 may be positioned at the top 14 of the interior of the oven 10 near the center thereof, i.e., above the heat transfer zone 18. The return duct 36 is in fluid communication with the interior of the oven 10 via a plurality of appropriate apertures 38 therein. Different or other return paths for the return air from the oven 10 may be established to achieve a desired air circulation pattern in the oven 10.

Figure 2:
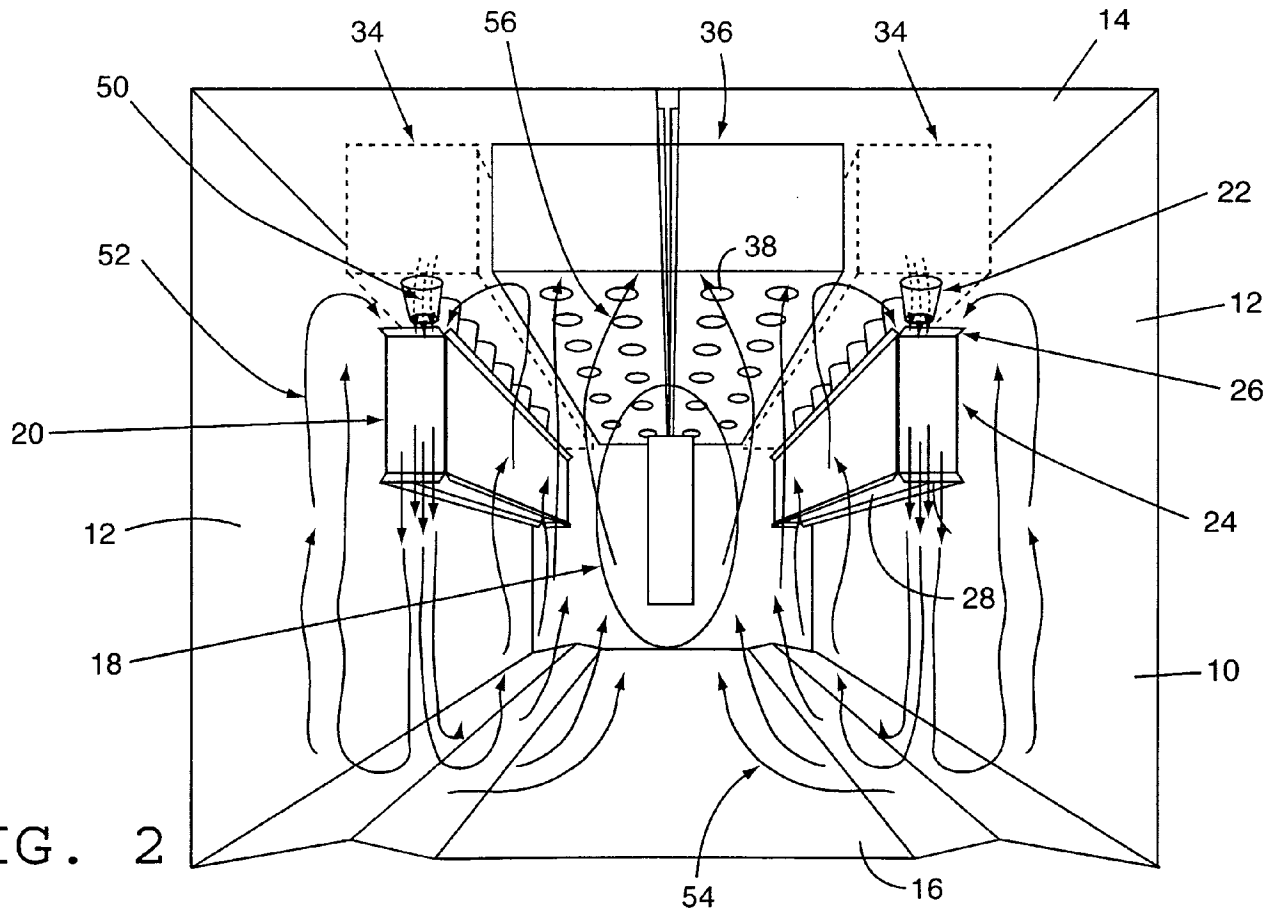
FIG. 2 is a perspective view illustration of an exemplary convection oven in accordance with the present invention as shown in FIG. 1 illustrating air flows through the oven when in operation.
Figure 3:
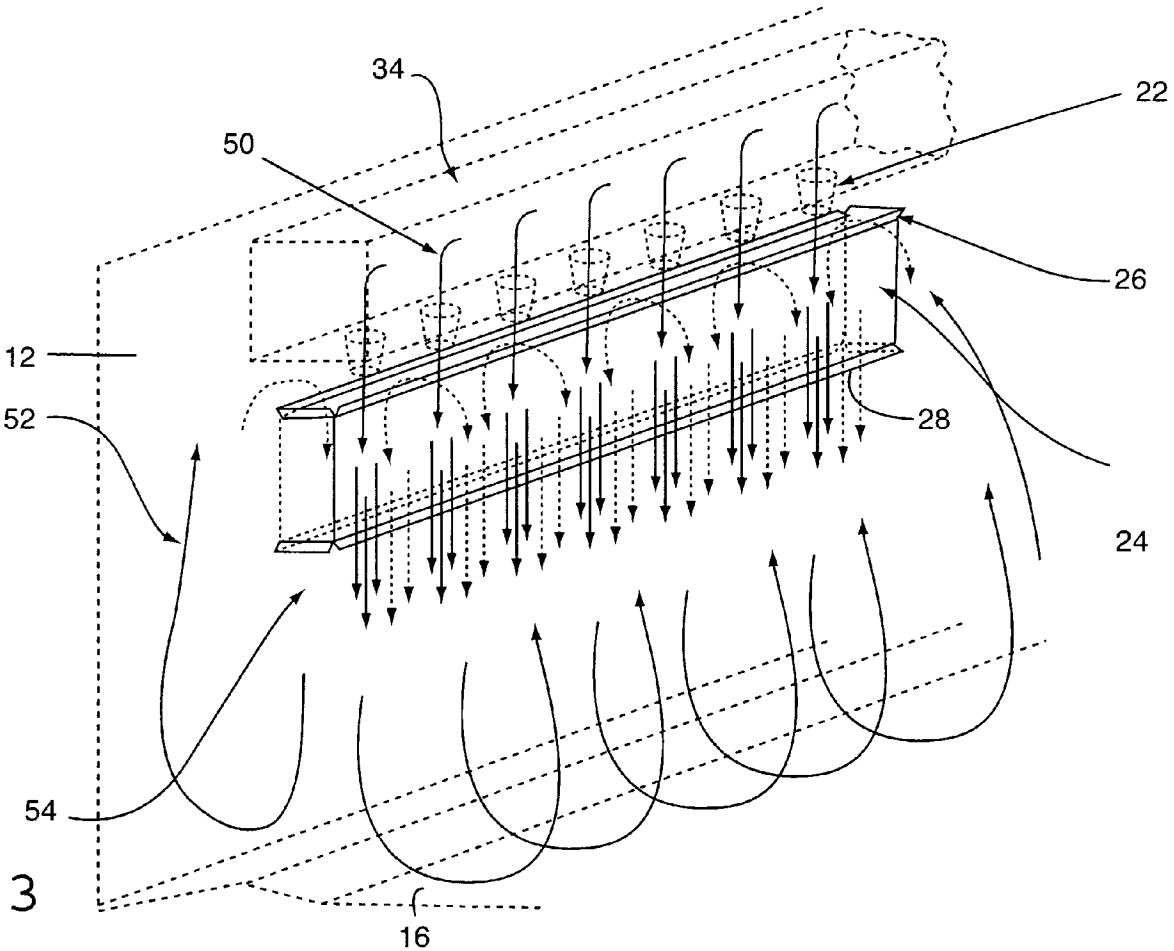
FIG. 3 is a more detailed perspective view illustration of the air flow through an exemplary turbo flow air nozzle employed in the exemplary convection oven in accordance with the present invention of FIGS. 1 and 2.

Improved air flow through the exemplary convection oven 10 in accordance with the present invention as illustrated in FIG. 1 now will be described in more detail with particular reference to the illustrations of FIGS. 2 and 3. During operation, the oven 10 is heated to the desired operating temperature and is maintained at the desired temperature using conventional oven temperature control and feedback systems. A work piece to be heated may be positioned in or passed through the heat transfer zone 18 of the oven 10.

With the fan 32 in operation, supply air 50 is provided via the supply ducts 34 to the supply nozzles 22 of the turbo flow air nozzles 20. This supply air 50 is directed at a high velocity into the open first end 26 of the air entrainment and mixing section 24 and through the air entrainment and mixing section 24. Air from the interior of the oven 10 is entrained 52 by the turbo flow air nozzles 20 as the high velocity air flow through the air entrainment and mixing section 24 draws air from the interior of the oven 10 into the open first end or entrainment lead in section 26 of the air entrainment and mixing section 24. Note that the turbo flow air nozzles 20 preferably may be positioned in the interior of the oven 10 such that air is drawn from all directions into the entrainment lead in section 26 of the air entrainment and mixing section 24. This entrained air 52 is thus mixed in the air entrainment and mixing section 24 with the supply air 50 from the supply nozzles 22.

The mixed 54 entrained 52 and supply 50 air flows out of the second open end 28 of the air entrainment and mixing section 24 in this case downward toward the bottom 16 of the oven 10. The mixed air 54 is directed upward from the bottom 16 of the oven through the heat transfer zone 18, around the work piece to be heated, and then turns and flows back into the air entrainment and mixing section 24 as entrained air 52. Some of the mixed air 54 flowing upward through the heat transfer zone 18 is drawn as return air 56 into the return duct 36, to be redirected by the fan 32 through the supply nozzles 22 as supply air.

A convection oven 10 employing turbo flow air nozzles 20 in accordance with the present invention thus provides increased air flow to a work piece positioned in the heat transfer zone 18 of the oven 10. This provides for more efficient, rapid, and better controlled heating of the work piece, thereby increasing work piece throughput. The operating temperature of the oven, fan operating speed, and air flow speed and volume through the turbo flow air nozzles all may be selected to achieve the desired oven operating conditions required for the work piece processing operation to be performed in the oven. The ratio of air flow 54 out of the turbo flow nozzle 20 to supply air 50 provided by the fan 32 through the supply nozzles 22 is equal approximately to the square root of the ratio of turbo flow nozzle flow area to supply nozzle flow area. Thus, the degree of enhanced air flow in the heat transfer zone 18 of the oven 10 can be selected based on selecting the relative parameters of the components of the turbo flow nozzles 20 used and can be achieved using significantly less fan capacity than can be achieved using conventional high velocity air supply nozzles alone.

It should be understood that a convection oven 10 employing turbo flow air nozzles 20 in accordance with the present invention may employ various other different or similar conventional systems, fans, nozzles, ductwork, etc. from those illustrated and described in detail herein for providing improved air flow through the interior of the oven 10. For example, alternative embodiment components of a convection oven 10 in accordance with the present invention are illustrated in dashed lines in FIG. 1. In one exemplary alternative embodiment, conventional air nozzles 60 are provided in the bottom 16 of the oven 10 (only a few exemplary conventional nozzles 60 are illustrated in FIG. 1.) Air flow from the fan 32, via an appropriate air supply duct 62, may be directed upward through the heat transfer zone 18 from these conventional air nozzles 60, further to increase air flow through the oven 10. In a further alternative embodiment, a separate fan 64 may be used to direct air through the conventional nozzles 60 located in the bottom 16 of the oven. In this case, a return duct 66 for the air flow passing through the turbo flow nozzles 20 may be located in the bottom 16 of the oven 10. Thus, the mixed air flow 54 from the bottom 16 of the oven 10 may not include the air flow passing the supply nozzles 22. The air flow passing through the return duct 66 does not pass through the heat transfer zone 18.

It should be understood that the present invention is not limited to the particular exemplary applications and embodiments illustrated and described herein, but embraces all such modified forms thereof as come within the scope of the following claims.

What is claimed is:

1. A convection oven having side walls, a top, and a bottom defining an interior of the oven, with enhanced air flow through a heat transfer zone in the interior of the oven, comprising:

(a) at least one air supply nozzle positioned for directing a supply air flow therefrom toward the interior of the oven;

(b) at least one air entrainment and mixing section having an open first end and an open second end and positioned adjacent to the at least one air supply nozzle such that the supply air flow is directed into the open first end of the air entrainment and mixing section and such that the open first end of the air entrainment and mixing section is in fluid communication with the interior of the oven to entrain air from the interior of the oven through the open first end of the air entrainment and mixing section when the at least one air supply nozzle directs the supply air flow therethrough and to direct mixed supply air and entrained air into the interior of the oven from the open second end thereof;

(c) an air supply duct coupled to the at least one air supply nozzle for providing supply air thereto;

(d) an air return path coupled in fluid communication with the interior of the oven; and (e) a fan coupled to the air supply duct for directing air from the air return path to the air supply duct.

2. The convection oven of claim 1 wherein the at least one air supply nozzle is positioned at the top of the oven near a side wall thereof for directing a supply air flow downward therefrom, and wherein the air entrainment and mixing section is positioned below the at least one air supply nozzle such that the supply air flow is directed downward into the open first end of the air entrainment and mixing section.

3. The convection oven of claim 1 wherein a plurality of air supply nozzles are positioned to direct the supply air flow into a single air entrainment and mixing section.

4. The convection oven of claim 1 comprising additionally air flow nozzles in the bottom of the oven and coupled to the fan to direct air flow upward through the heat transfer zone therefrom.

5. The convection oven of claim 1 comprising additionally air flow nozzles in the bottom of the oven and a second fan coupled to the air flow nozzles in the bottom of the oven to direct air flow upward through the heat transfer zone therefrom.

6. The convection oven of claim 1 wherein the air return path is coupled in fluid communication with the interior of the oven at the top of the oven.

7. The convection oven of claim 1 wherein the air return path is coupled in fluid communication with the interior of the oven at the bottom of the oven below the air entrainment and mixing section.

8. The convection oven of claim 1 wherein the air supply nozzles are conical nozzles.

9. The convection oven of claim 1 wherein the air entrainment and mixing section is box shaped.

10. The convection oven of claim 1 wherein the air return path includes an air return duct coupled in fluid communication with the interior of the oven and wherein the fan is coupled to the air supply duct and to the air return duct for directing air from the interior of the oven from the air return duct to the air supply duct.

11. A method for heating a work piece in a convection oven having side walls, a top, and a bottom defining an interior of the oven, with enhanced air flow through a heat transfer zone in the interior of the oven, comprising:

(a) providing at least one air supply nozzle positioned for directing a supply air flow therefrom toward the interior of the oven;

(b) providing at least one air entrainment and mixing section positioned adjacent to the at least one air supply nozzle and having an open first end in fluid communication with the interior of the oven and an open second end;

(c) directing a supply air flow from the at least one air supply nozzle into the open first end of the air entrainment and mixing section such that air from the interior of the oven is entrained through the open first end of the air entrainment and mixing section and such that mixed supply air and entrained air is directed into the interior of the oven from the open second end of the air entrainment and mixing section thereby to generate an air flow through the heat transfer zone; and (d) positioning a work piece to be heated in the heat transfer zone of the oven.

12. The method of claim 11 wherein directing a supply air flow from the at least one air supply nozzle includes operating a fan to direct a supply air flow via an air supply duct to the at least one air supply nozzle.

13. The method of claim 11 wherein the at least one air supply nozzle is positioned at the top of the oven near a side wall thereof and wherein the air entrainment and mixing section is positioned below the at least one air supply nozzle and wherein directing a supply air flow from the at least one air supply nozzle includes directing the supply air flow downward from the at least one air supply nozzle into the open first end of the air entrainment and mixing section.

14. The method of claim 11 wherein a plurality of air supply nozzles are provided to direct the supply air flow into a single air entrainment and mixing section.

15. The method of claim 11 comprising additionally the step of directing an air flow upward from the bottom of the oven directly through the heat transfer zone.

16. The method of claim 11 comprising additionally providing an air return path coupled in fluid communication with the interior of the oven at the top of the oven.

17. The method of claim 11 comprising additionally providing an air return path coupled in fluid communication with the interior of the oven at the bottom of the oven below the air entrainment and mixing section.

18. A convection oven having side walls, a top, and a bottom defining an interior of the oven, with enhanced air flow through a heat transfer zone in the interior of the oven, comprising:

(a) a plurality of air supply nozzles positioned at the top of the oven near a side wall thereof for directing a supply air flow downward therefrom;

(b) at least one air entrainment and mixing section having an open first end and an open second end and positioned below the plurality of air supply nozzles such that the supply air flow is directed downward into the open first end of the air entrainment and mixing section and such that the open first end of the air entrainment and mixing section is in fluid communication with the interior of the oven to entrain air from the interior of the oven through the open first end of the air entrainment and mixing section when the plurality of air supply nozzles direct the supply air flow therethrough and to direct mixed supply air and entrained air into the interior of the oven from the open second end thereof;

(c) an air supply duct coupled to the plurality of air supply nozzles for providing supply air thereto;

(d) an air return path coupled in fluid communication with the interior of the oven; and (e) a fan coupled to the air supply duct for directing air from the air return path to the air supply duct.

19. The convection oven of claim 18 comprising additionally air flow nozzles in the bottom of the oven and coupled to the fan to direct air flow upward through the heat transfer zone therefrom.

20. The convection oven of claim 18 comprising additionally air flow nozzles in the bottom of the oven and a second fan coupled to the air flow nozzles in the bottom of the oven to direct air flow upward through the heat transfer zone therefrom.

* * * * *